US011015353B1

(12) United States Patent
Guidi et al.

(10) Patent No.: US 11,015,353 B1
(45) Date of Patent: May 25, 2021

(54) MOLDING WITH SLOT

(71) Applicant: Fig Tree Inc., Plantation, FL (US)

(72) Inventors: Alejandro E. Guidi, Plantation, FL (US); Karina F. Amor, Plantation, FL (US)

(73) Assignee: Fig Tree Inc., Plantation, FL (US)

( * ) Notice: Subject to any disclaimer, the term of this patent is extended or adjusted under 35 U.S.C. 154(b) by 0 days.

(21) Appl. No.: 16/795,341

(22) Filed: Feb. 19, 2020

(51) Int. Cl.

| | |
|---|---|
| ***E04F 19/04*** | (2006.01) |
| ***F21S 4/28*** | (2016.01) |
| ***F21K 9/66*** | (2016.01) |
| ***F21Y 115/10*** | (2016.01) |

(52) U.S. Cl.
CPC ..... *E04F 19/04* (2013.01); *F21K 9/66* (2016.08); *F21S 4/28* (2016.01); *F21Y 2115/10* (2016.08)

(58) Field of Classification Search
CPC ..... E04F 19/04; F21S 4/28; F21K 9/66
USPC ..... 362/217.01
See application file for complete search history.

(56) References Cited

U.S. PATENT DOCUMENTS

| | | | | | |
|---|---|---|---|---|---|
| 1,488,090 | A * | 3/1924 | Buhr | E04F 19/04 | 52/288.1 |
| 2,564,373 | A * | 8/1951 | Potter | F21V 7/04 | 362/223 |
| 3,564,797 | A * | 2/1971 | Willfurth | E04F 19/04 | 52/287.1 |
| 3,601,601 | A * | 8/1971 | Eilenberger | F21L 15/00 | 362/158 |
| 5,570,946 | A * | 11/1996 | Chien | A42B 3/044 | 362/106 |
| 5,743,621 | A * | 4/1998 | Mantha | A42B 3/044 | 362/105 |
| 6,565,236 | B1 * | 5/2003 | Davis, Jr. | F21S 8/02 | 362/147 |
| 7,574,836 | B2 | 8/2009 | Wesolowska | | |
| 8,220,953 | B1 * | 7/2012 | Moore | F21S 8/04 | 362/217.01 |
| 9,695,991 | B2 | 7/2017 | Camarota | | |
| 2001/0022730 | A1 * | 9/2001 | Nagata | B60Q 3/51 | 362/490 |
| 2004/0040235 | A1 | 3/2004 | Kurtz | | |
| 2007/0183156 | A1 * | 8/2007 | Shan | F21V 29/70 | 362/277 |
| 2009/0303411 | A1 * | 12/2009 | Kawato | B29D 11/00605 | 349/61 |
| 2010/0019689 | A1 * | 1/2010 | Shan | F21V 29/74 | 315/294 |
| 2010/0027263 | A1 * | 2/2010 | Wang | F21V 29/763 | 362/249.06 |

FOREIGN PATENT DOCUMENTS

| | | |
|---|---|---|
| KR | 20090003636 U | 4/2009 |

* cited by examiner

*Primary Examiner* — Bryon T Gyllstrom
(74) *Attorney, Agent, or Firm* — Pablo Meles

(57) ABSTRACT

A molding includes a molded member including a horizontal channel on a front facing portion of the molding, an upper vertical slot in the horizontal channel and a lower vertical slot in the horizontal channel. In some arrangements, the upper vertical slot and the lower vertical slot are formed and adapted to receive a laminar insert or a light diffusing cover.

20 Claims, 3 Drawing Sheets

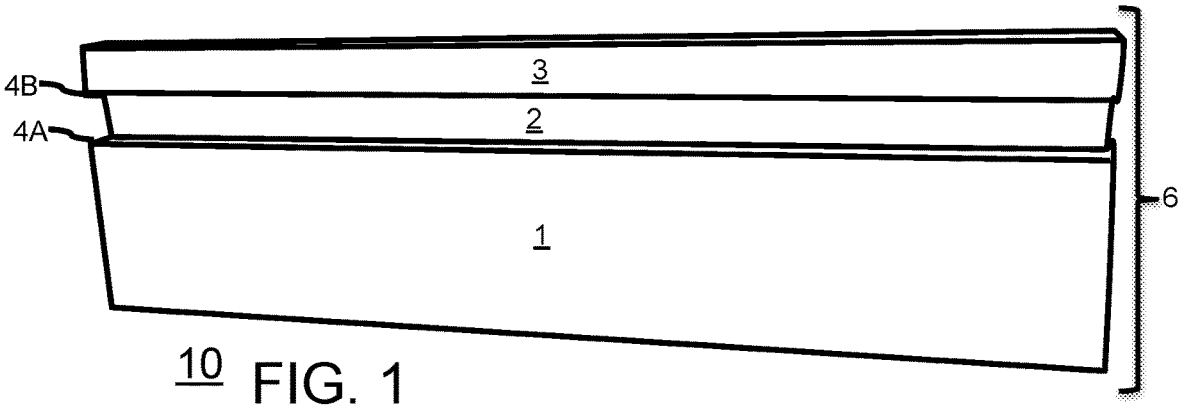
10 FIG. 1
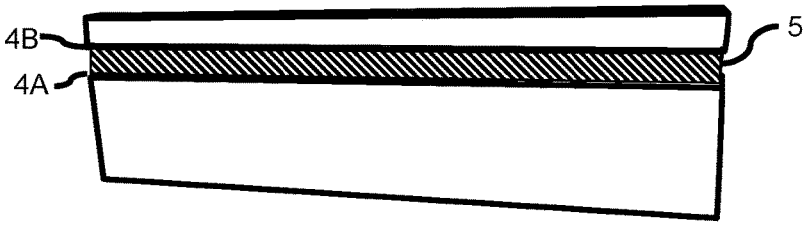
10 FIG. 2
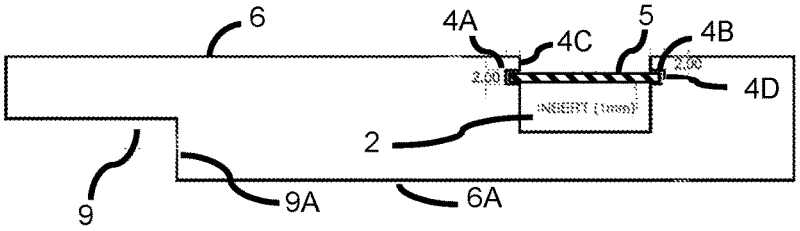
10 FIG. 3
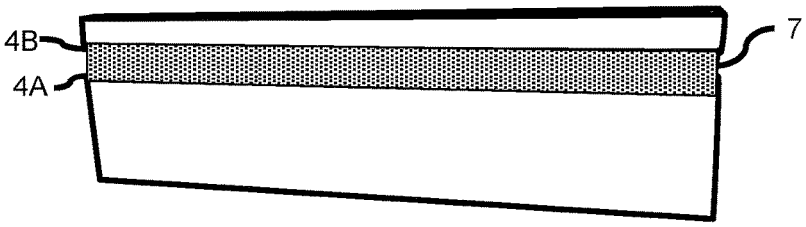
10 FIG. 4
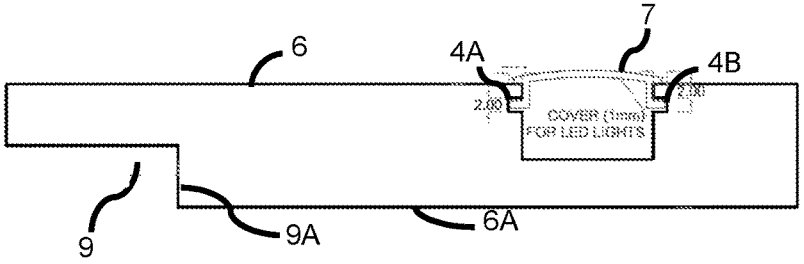
10 FIG. 5

20
11
100

9
20
9A
6
6A
10
2
5
120

9
20
9A
8
10
8
2
5A
150

20
10
4B
8
2
7
4A
170

20
2
10
9A
9A
10

200

300

MOLDING WITH SLOT

CROSS-REFERENCE TO RELATED APPLICATIONS

N/A

FIELD OF THE DISCLOSURE

The present disclosure generally relates to systems and methods in the field of molding, and more particularly relates to molding with a slot and/or channel.

BACKGROUND

Moldings are commonly used for baseboards and crown moldings on ceilings or adjacent to ceilings. Existing molding is commonly made of wood and typically requires sanding, painting and other labor to provide additional decorative finishes to such molding. Furthermore, wood moldings can be fragile and susceptible to damage upon installation or when adding decorative highlights to such molding.

SUMMARY

In some embodiments, a molding includes an molded member including a horizontal channel on a front facing portion of the molding, an upper vertical slot in the horizontal channel, and a lower vertical slot in the horizontal channel. The molding can be made of a number of materials including, but not limited to Polystyrene, PVC, plastic, acrylonitrile butadiene styrene (ABS) plastic, Styrofoam, wood, medium-density fibreboard, or resins. The upper vertical slot and the lower vertical slot are formed and adapted to receive a laminar insert or a light diffusing cover.

In some embodiments, the upper vertical slot and the lower vertical slot are formed and adapted to receive the laminar insert or the light diffusing cover by sliding the laminar insert or the light diffusing cover into the upper vertical slot and lower vertical slot. In some embodiments, the upper vertical slot and the lower vertical slot are formed and adapted to receive the laminar insert or the light diffusing cover by press fitting the laminar insert or the light diffusing cover onto the upper vertical slot and lower vertical slot from the front facing portion of the molding.

In some embodiments, the upper vertical slot in the horizontal channel has a width no greater than 2 millimeters. In some embodiments, the lower vertical slot in the horizontal channel has a width no greater than 2 millimeters. In some embodiments, both the upper and lower vertical slots have a width no greater than 2 millimeters. In some embodiments, the upper vertical slot and the lower vertical slot are inset no more than 2 millimeters from the front facing portion of the molding. In some embodiments, the upper vertical slot and the lower vertical slot have a width that is a one to one ratio with the depth of the upper and lower vertical slots within the horizontal channel. In some embodiments, the horizontal channel is on an upper portion of the front facing portion of the molding while in other embodiments the horizontal channel can be on an lower portion of the front facing portion of the molding.

In some embodiments, the horizontal channel is on an upper portion of the front facing portion of the molding and the molding further includes a cut-out portion forming a ledge on a bottom portion of a rear facing portion of the molding. In some embodiments, the horizontal channel is on an lower portion of the front facing portion of the molding and the molding further includes a cut-out portion forming a ledge on a top portion of a rear facing portion of the molding.

In some embodiments, the molded member is an injection molded member made of Polystyrene or other materials that provides for a smooth finished surface and in some embodiments the the injection-molded member made of Polystyrene or other materials can include colored pigments that provides for a smooth finished color surface. When made by injection molding or extrusion, the use of colored pigments enables a smooth finished color surface that does not necessarily require any further painting or finishing before mounting on to a wall. In other words, it is a finished product ready for mounting with no further need for sanding, priming or painting. Of course, if a different color is desired than the embedded pigment in the molding, the user always has the option to paint over the desired surfaces of the molding. In some embodiments, the molded member can be made with other materials and further constructed using a Computer Numerical Control or CNC machine or tool where other materials such as PVC, wood, or medium-density fibreboard can be used as alternatives. In yet other embodiments, the molded member can be made using a 3D printer and materials such as plastic or resin.

In some embodiments, the channel is further adapted to receive LED lighting strips. In other embodiments, the ledge is configured to receive LED lighting strips.

A molding can include an injection molded member including a horizontal channel on a front facing portion of the molding, an upper vertical slot in the horizontal channel, and a lower vertical slot in the horizontal channel. The upper vertical slot and the lower vertical slot are formed and adapted to receive a laminar insert or a light diffusing cover.

In some embodiments, the horizontal channel is on an upper portion of the front facing portion of the molding and the molding further includes a cut-out portion forming a ledge on a bottom portion of a rear facing portion of the molding and where the ledge has a depth of approximately half the thickness of the injection molded member enabling the flat stacking of two moldings. In some embodiments, the lower vertical slot in the horizontal channel has a width no greater than 2 millimeters and the upper vertical slot and the lower vertical slot have a width that is a one to one ratio with the depth of the upper and lower vertical slots within the horizontal channel.

In some embodiments, a molding includes an injection molded member including a horizontal channel on a front facing portion of the molding, an upper vertical slot in the horizontal channel, and a lower vertical slot in the horizontal channel. The upper vertical slot and the lower vertical slot are formed and adapted to receive a laminar insert or a light diffusing cover by sliding the laminar insert or the light diffusing cover into the upper and lower vertical slots or by press fitting the laminar insert or the light diffusing cover onto the upper and lower vertical slots.

BRIEF DESCRIPTION OF DRAWINGS

FIG. 1 illustrates a front left perspective view of a molding according to one embodiment of the disclosure;

FIG. 2 illustrates a front left perspective view of the molding of FIG. 1 having a decorative insert according to one embodiment of the disclosure;

FIG. 3 is a left plan view of of the molding and decorative insert of FIG. 2 in accordance with an embodiment of the disclosure;

FIG. 4 illustrates a front left perspective view of the molding of FIG. 1 having a light diffuser cover according to one embodiment of the disclosure;

FIG. 5 is a left plan view of of the molding and light diffuser cover of FIG. 4 in accordance with an embodiment of the disclosure;

DETAILED DESCRIPTION

Glossary of Terms

Figures 6, 7, 8, 9, 10:
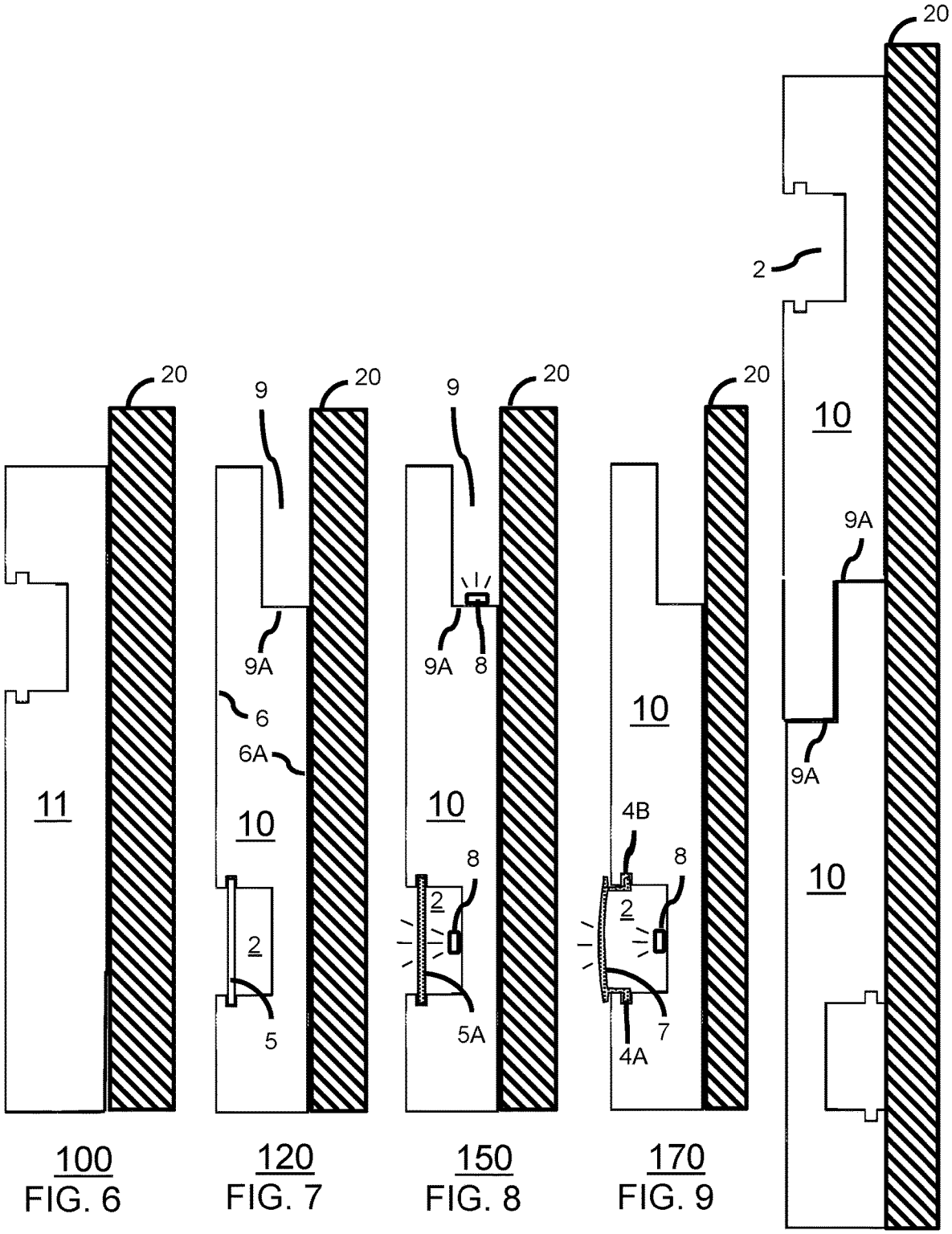
FIG. 6 is a left plan view of a molding mounted on a wall with the channel on an upper portion of the molding in accordance with an embodiment of the disclosure.
FIG. 7 is a left plan view of the molding of FIG. 1 mounted on a wall with the channel on a lower portion of the molding and further including the decorative insert within at least a slot of the channel of the molding in accordance with an embodiment of the disclosure.
FIG. 8 is a left plan view of the molding of FIG. 1 mounted on a wall with the channel on a lower portion and a cut-out portion on an upper portion of the molding and further including a transluscent or diffusing insert within at least a slot of the channel, an LED strip light within the channel and an LED strip light on a ledge of the cut-out portion in accordance with an embodiment of the disclosure.
FIG. 9 is a left plan view of the molding of FIG. 1 mounted on a wall with the channel on a lower portion and further including a transluscent or diffusing member within at least a slot of the channel, and an LED strip light within the channel in accordance with an embodiment of the disclosure.
FIG. 10 is a left plan view of two of the moldings of FIG. 1 stacked together at mating ledges and mounted on a wall with the channel on a upper portion in accordance with an embodiment of the disclosure.

Cavity or channel—is an empty space or volume.

A slot is a narrow aperture or slit in an element, apparatus or member for something to be inserted.

Unitary piece—is a number of portions of an apparatus or device made from a single piece of material such as a single piece of molded or 3-D printed plastic or other material. A unitary piece can also include an apparatus or device that is double-shot molded.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value.

In this specification and the claims that follow, singular forms such as "a", "an", and "the" include plural forms unless the content clearly dictates otherwise.

In some embodiments according to the present disclosure, the molding may be assembled from multiple pieces or elements or in other embodiments the molding can be made from a unitary piece. The unitary piece can be made from a single material such as plastic or can also be made of multiple materials such as coated plastic or coated metal.

In some embodiments, the embodiments herein can be formed by using 3 dimensional printing or a 3-D printer. In other embodiments, the embodiments herein can be formed using a molding process such as injection molding, or single shot or double shot molding. In some embodiments, the moldiings can be formed using tools such as CNC machines that can include routers and lathes. In yet other embodiments, a molding member can be made by injection molding or extrusion and further use colored pigments to enable a smooth finished color surface that does not necessarily require any further painting or finishing before mounting on to a wall. In other words, it is a finished product ready for mounting with no further need for sanding, priming or painting. Of course, if a different color is desired than the embedded pigment in the molding, the user always has the option to paint over the desired surfaces of the molding. In some embodiments, the molded member can be made with other materials and further constructed using the CNC machine or tool where other materials such as PVC, wood, or medium-density fibreboard can be used as alternatives within contemplation of the embodiments herein. In yet other embodiments, the molded member can be made using a 3D printer and materials such as plastic or resin. In each particular technique of construction, particular attention may be needed with respect to the hardness and/or resilience of the materials selected and to the structure and dimensions so that a high quality, non-defective end product is created that can withstand numerous insertions and removals of the laminer inserts or the light diffusion covers. For example, a wood that is used to make rulers having a 70 Shore D hardness score would not likely be suitable for most implementations. Therefore, a wood having a Shore D hardness score higher than 70 might be suitable. Hardness is measured using a number of different methods and scales such as Rockwell hardness or Shore hardness. The Rockwell method is typically used for harder plastics such as polycarbonate, nylon, acetal, and Polystyrene. Therefore a comprehensive list of ranges is certainly determinable, but the end result should provide a material and structure that enables durability and quality. Polystyrene has been found to fit many of the desireable qualities in terms of cost, durability, strength, weight, and manufacturability where an injection molded Polystyrene not only results in a "finished" product with finished surfaces all around, but Polystyrene can also provide options that are "green" or good for the environment as Polystyrene can be made with recycled content as well.

Referring to FIGS. 1-5, a molding 10 includes an molded member including a horizontal channel 2 on a front facing portion 6 of the molding, an upper vertical slot 4B in the horizontal channel 2, and a lower vertical slot 4A in the horizontal channel 2. The front facing portion 6 can include a lower front facing portion 1 and an upper front facing portion 3. The molding can be made of a number of materials including, but not limited to Polystyrene, PVC, plastic, ABS plastic, Styrofoam, wood, medium-density fibreboard, or resins. The upper vertical slot 4B and the lower vertical slot 4A are formed and adapted to receive a laminar insert 5 or a light diffusing cover 7. The laminer insert 5 or light diffusing cover 7 can serve as a selectable and variable decorative highlight to the molding 10. The light diffusing cover 7 also serve to diffuse a light source such as an light emitting diode or LED 8 (see FIG. 8 or 9) that can be placed within the channel 2. The laminer insert 5 can be made of any material such as plastic, PVC, laminated wood and can be configured to have any design or texture as desired so long as the laminer insert 5 can be slid into the upper and lower vertical slots (4B and 4A) or press fit into such slots.

As noted above, the upper vertical slot 4B and the lower vertical slot 4A are formed and adapted to receive the laminar insert 5 or the light diffusing cover 7 by sliding the laminar insert or the light diffusing cover into the upper vertical slot and lower vertical slot. In some embodiments, the upper vertical slot and the lower vertical slot are formed and adapted to receive the laminar insert or the light diffusing cover by press fitting the laminar insert or the light diffusing cover onto the upper vertical slot and lower vertical slot from the front facing portion 6 of the molding 10.

Referring to FIGS. 1-5 and more particularly to FIGS. 2 and 5, in some embodiments the upper vertical slot 4B in the horizontal channel 2 has a width no greater than 2 millimeters. In some embodiments, the lower vertical slot 4A in the horizontal channel 2 has a width no greater than 2 millimeters. In some embodiments, both the upper and lower vertical slots (4B and 4A) have a width no greater than 2 millimeters. In some embodiments, the upper vertical slot and the lower vertical slot are inset no more than 2 millimeters from the front facing portion 6 of the molding 10. The inset portion or depth of the vertical slot away from the front facing portion 6 having a dimension of no more than 2 millimeters is designated by 4C as shown in FIG. 3. In some embodiments, the upper vertical slot 4B and the lower vertical slot 4A have a width (4D) that is a one to one ratio with the depth (4C) of the upper and lower vertical slots within the horizontal channel 2. If the aforementioned 2 millimeter dimensions are used, then the thickness of the laminer insert 5 or the thickness of the walls of the light diffusing cover 7 should be approximately 1 millimeter for example. Of course, the embodiments are not limited to the particular dimensions shown or described for the slots, or thickness of the walls of the inserts. Since the injection molded member is made of Polystyrene or other hard materials having a sufficiently high enough durometer and/or resliency, the slot or slots (4B and 4A) will not easily deform or break from the manufacturing process or from inserting, slipping, or press fitting the insert or light diffusing cover. Under usual circumstances, a thin slot having such a small depth or inset will be subject to breakage (in manufacture or usage) if made from softer woods or other less durable materials. If wood or other materials are used, such materials should be selected or further processed to have a hardness or durometer or other properties close to that of Polystyrene. Most natural woods are likely unsuited for this structure.

In some embodiments, the horizontal channel 2 is on an upper portion of the front facing portion of the molding (as shown in FIG. 6) while in other embodiments the horizontal channel 2 can be on an lower portion of the front facing portion (as shown in FIGS. 7-9) of the molding.

In some embodiments as illustrated by at least FIGS. 3 and 5 the horizontal channel 2 is on an upper portion of the front facing portion 6 of the molding 10 and the molding 10 further includes a cut-out portion 9 forming a ledge 9A on a bottom portion of a rear facing portion 6A of the molding 10. In some embodiments as illustrated by the assembly 120 of FIG. 7, the horizontal channel 2 is on an lower portion of the front facing portion 6 of the molding 10 and the molding 10 further includes a cut-out portion 9 forming a ledge 9A on a top portion of a rear facing portion 6A of the molding 10.

Note that the cut-out portion 9 shown in FIG. 3, 5, or 7 is just optional and some embodiments can omit having a cut-out portion as shown in an injection molded member 11 of a molding assembly 100 as shown in FIG. 6. Having the molded member 11 mounted to a wall 20. The molded member 11 can be mounted or attached to the wall 20 using adhesive, nails, screws, or other mounting devices.

In some embodiments, the molding 10 or injection molded member 10 is made of Polystyrene and provides for a smooth finished surface (which can be a smooth finished surface on all surfaces of the injection molded member or only a smooth finished surface on some selected surfaces of the injection molded member) and in some embodiments the injection-molded member 10 can be made of Polystyrene or other materials and that further includes colored pigment that provides for a smooth finished colored surface. The injection molding or extrusion process and the materials used provide for the smooth surface which would not necessarily need sanding, primer, or paint. In other words, the product is a finished product ready to be mounted on a wall as a baseboard, crown molding, or other decorative accent on one or more edges of a room without any further "finishing". Mounting of the molding can be done with adhesives or nails (or even screws) as is customarily done with conventional wood molding.

In some embodiments as shown in assembly 150 of FIG. 8 or the assembly 170 of FIG. 9, the channel 2 is further adapted to receive LED lighting strips or at least one LED 8. In some embodiments as shown in FIG. 8, the ledge 9A within the cut-out portion 9 is configured to receive LED lighting strips or an LED 8 as well. The assembly 150 of FIG. 8 thus provides a highlighted light that is diffused from the channel 2 from an LED 8 and via a insert 5A that is translucent or at least partially translucent and diffuses light (rather than the laminer insert 5 of FIG. 7 that blocks light). The assembly 150 also includes a second light or LED 8 that emanates from the top of the molding 10 from the cut-out portion 9. In FIG. 9, the diffusing light cover 7 can either be press fit into the slots (4B and 4A) or slid into such slots. In any case, the material used is sufficiently hard enough to avoid deforming or breaking the slots when the inserts or light diffuser covers are placed within the slots or press fit onto the slots even when such slots are relatively thin. Also, having a slot width and a depth dimension to the slot that is on a one to one ratio further provides rigidity and strength to avoid product failure.

As noted previously, the molding 10 can include an injection molded member including a horizontal channel 2 on a front facing portion 6 of the molding, an upper vertical slot 4B in the horizontal channel, and a lower vertical slot 4A in the horizontal channel. The upper vertical slot and the lower vertical slot are formed and adapted to receive a laminar insert (5 or 5A) or a light diffusing cover 7.

In some embodiments, the horizontal channel is on an upper portion of the front facing portion of the molding and the molding further includes a cut-out portion forming a ledge on a bottom portion of a rear facing portion of the molding and where the ledge has a depth of approximately half the thickness of the injection molded member enabling the flat stacking of two moldings. In some embodiments, the lower vertical slot in the horizontal channel has a width no greater than 2 millimeters and the upper vertical slot and the lower vertical slot have a width that is a one to one ratio with the depth of the upper and lower vertical slots within the horizontal channel. As previously noted, the embodiments are not limited to such dimensions and the dimensions are only provided in the description and drawings as exemplary dimensions. For example, in some embodiments, the lower vertical slot or upper vertical slot can have a width no greater than 3, 4, 5, 6, or 7 millimeters.

In some embodiments, the molding includes an injection molded member including a horizontal channel on a front facing portion of the molding, an upper vertical slot in the horizontal channel, and a lower vertical slot in the horizontal channel. The upper vertical slot and the lower vertical slot are formed and adapted to receive a laminar insert or a light diffusing cover by sliding the laminar insert or the light diffusing cover into the upper and lower vertical slots or by press fitting the laminar insert or the light diffusing cover onto the upper and lower vertical slots.

Referring to FIG. 10, an assembly 200 includes two moldings 10 stacked together and mated at their respective ledges 9A and further mounted to the wall 20. In this manner, an extra tall baseboard or crown molding (that is almost twice as tall as using a single molding 10) is created that still provides an exposed channel 2. In any of the designs, the molding can leave the channel open without a laminer insert or any variety of decorated laminer inserts can be inserted within the slots or a light diffusing cover can be used particularly when a light source is provided within the channel 2.

Figure 11:
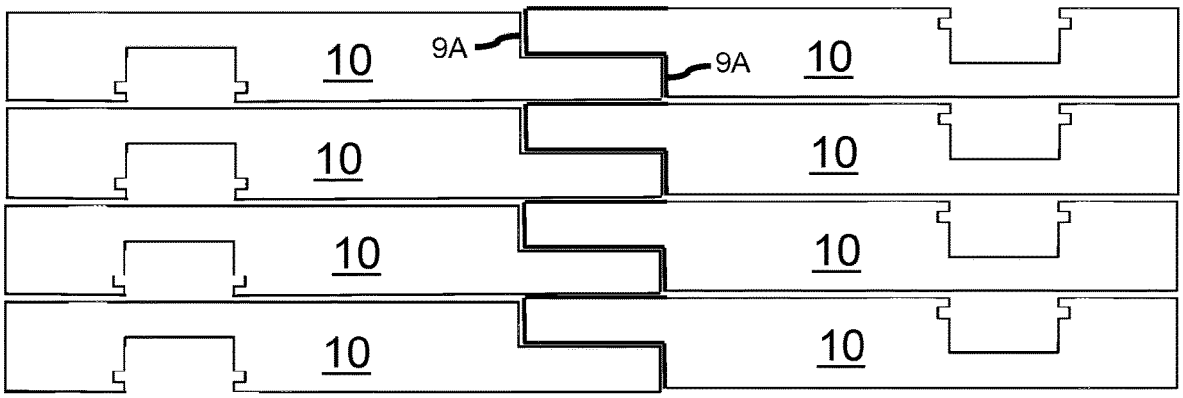
FIG. 11 is a left plan view of multiple moldings of FIG. 1 stacked side by side and on top of each other for efficient storage and shipping in accordance with an embodiment of the disclosure.

Referring to the assembly 300 of FIG. 11, when storing and shipping the molding 10, it can be efficiently stored or shipped by mating cut-out portions (9) that mate with respective ledges 9A and then piling or stacking the two moldings mated together on top of each other as shown in FIG. 11.

It will be appreciated by those skilled in the art that the present invention can be embodied in other specific forms without departing from the spirit or essential characteristics thereof. The presently disclosed embodiments are therefore considered in all respects to be illustrative and not restricted. Modifications and variations are possible in light of the above teachings or may be acquired from practicing of the disclosure, without departing from the breadth or scope.

What is claimed is:

1. A decorative baseboard molding, comprising:

a molded member made of a unitary piece of polystyrene including a horizontal channel on a front facing portion of the decorative baseboard molding and serving as the decorative baseboard molding;

an upper vertical slot in the horizontal channel;

a lower vertical slot in the horizontal channel; and wherein the upper vertical slot and the lower vertical slot are formed and adapted to receive a laminar insert or a light diffusing cover.

2. The decorative baseboard molding of claim 1, wherein the upper vertical slot and the lower vertical slot are formed and adapted to receive the laminar insert or the light diffusing cover by sliding the laminar insert or the light diffusing cover into the upper vertical slot and lower vertical slot.

3. The decorative baseboard molding of claim 1, wherein the upper vertical slot and the lower vertical slot are formed and adapted to receive the laminar insert or the light diffusing cover by press fitting the laminar insert or the light diffusing cover onto the upper vertical slot and lower vertical slot from the front facing portion of the molding.

4. The decorative baseboard molding of claim 1, wherein the upper vertical slot in the horizontal channel has a width no greater than 2 millimeters.

5. The decorative baseboard molding of claim 1, wherein the lower vertical slot in the horizontal channel has a width no greater than 2 millimeters.

6. The decorative baseboard molding of claim 1, wherein the upper vertical slot and the lower vertical slot are inset no more than 2 millimeters from the front facing portion of the molding.

7. The decorative baseboard molding of claim 1, wherein the upper vertical slot and the lower vertical slot have a width that is a one to one ratio with the depth of the upper and lower vertical slots within the horizontal channel.

8. The decorative baseboard molding of claim 1, wherein the horizontal channel is on an upper portion of the front facing portion of the molding.

9. The decorative baseboard molding of claim 1, wherein the horizontal channel is on a lower portion of the front facing portion of the molding.

10. The decorative baseboard molding of claim 1, wherein the horizontal channel is on an upper portion of the front facing portion of the molding and the molding further includes a cut-out portion forming a ledge on a bottom portion of a rear facing portion of the molding.

11. The decorative baseboard molding of claim 1, wherein the horizontal channel is on an lower portion of the front facing portion of the molding and the molding further includes a cut-out portion forming a ledge on a top portion of a rear facing portion of the molding.

12. The decorative baseboard molding of claim 11, wherein the ledge is configured to receive LED lighting strips.

13. The decorative baseboard molding of claim 1, wherein the molded member made of Polystyrene provides for a smooth finished surface on all surfaces of the injection-molded member.

14. The decorative baseboard molding of claim 1, wherein the molded member made of Polystyrene further includes a colored pigment that provides for a smooth finished colored surface.

15. The decorative baseboard molding of claim 1, wherein the channel is further adapted to receive LED lighting strips.

16. The decorative baseboard molding of claim 1, wherein the molded member is made by injection molding or extrusion using Polystyrene.

17. A molding, comprising:

an injection molded member including a horizontal channel on a front facing portion of the molding;

an upper vertical slot in the horizontal channel;

a lower vertical slot in the horizontal channel;

wherein the upper vertical slot and the lower vertical slot are formed and adapted to receive a laminar insert or a light diffusing cover; and wherein the horizontal channel is on an upper portion of the front facing portion of the molding and the molding further includes a cut-out portion forming a ledge on a bottom portion of a rear facing portion of the molding and wherein the ledge has a depth of approximately half the thickness of the injection molded member enabling the flat stacking of two moldings.

18. The molding of claim 17, wherein the injection-molded member is made of Polystyrene.

19. The molding of claim 17, wherein the lower vertical slot in the horizontal channel has a width no greater than 2 or 3 or 4 or 5 or 6 or 7 millimeters and wherein the upper vertical slot and the lower vertical slot have a width that is a one to one ratio with the depth of the upper and lower vertical slots within the horizontal channel.

20. A decorative baseboard molding, comprising:

an injection molded member made from a unitary piece of Polystyrene including a horizontal channel on a front facing portion of the decorative baseboard molding;

an upper vertical slot in the horizontal channel;

a lower vertical slot in the horizontal channel; and wherein the upper vertical slot and the lower vertical slot are formed and adapted to receive a laminar insert by sliding the laminar insert into the upper and lower vertical slots or by press fitting the laminar insert onto the upper and lower vertical slots.

* * * * *